United States Patent [19]

Nakaniwa et al.

[11] Patent Number: 4,915,080

[45] Date of Patent: Apr. 10, 1990

[54] ELECTRONIC AIR-FUEL RATIO CONTROL APPARATUS IN INTERNAL COMBUSTION ENGINE

[75] Inventors: Shinpei Nakaniwa; Akira Uchikawa, both of Isesaki, Japan

[73] Assignee: Japan Electronic Control Systems Co., Ltd., Gunma, Japan

[21] Appl. No.: 246,746

[22] Filed: Sep. 20, 1988

[30] Foreign Application Priority Data

Sep. 22, 1987 [JP] Japan ..... 62-236300
Sep. 25, 1987 [JP] Japan ..... 62-238957

[51] Int. Cl.[4] ..... F02D 41/14
[52] U.S. Cl. ..... 123/489; 123/440; 204/426
[58] Field of Search ..... 123/440, 480, 489; 204/424, 425, 426

[56] References Cited

U.S. PATENT DOCUMENTS

| | | | |
|---|---|---|---|
| 4,134,375 | 1/1979 | Koseki et al. | 123/440 |
| 4,345,560 | 8/1982 | Nakamura et al. | 123/440 |
| 4,580,539 | 4/1986 | Kitahara | 123/440 |
| 4,615,319 | 10/1986 | Tomisawa | 123/440 |
| 4,655,188 | 4/1987 | Tomisawa et al. | 123/489 |
| 4,715,344 | 12/1987 | Tomisawa | 123/489 |
| 4,719,888 | 1/1988 | Kobayashi et al. | 123/440 |
| 4,727,845 | 3/1988 | Misumi et al. | 123/480 X |
| 4,729,359 | 3/1988 | Tomisawa et al. | 123/440 |

FOREIGN PATENT DOCUMENTS

| | | |
|---|---|---|
| 0267764 | 5/1988 | European Pat. Off. . |
| 0267765 | 5/1988 | European Pat. Off. . |
| 58-204365 | 11/1983 | Japan . |
| 60-240840 | 11/1985 | Japan . |
| 2165063 | 4/1986 | United Kingdom . |

*Primary Examiner*—Willis R. Wolfe
*Attorney, Agent, or Firm*—Sandler, Greenblum & Bernstein

[57] ABSTRACT

An electronic air-fuel ratio control apparatus in an internal combustion engine provided with an oxygen sensor emitting an output voltage in response to an oxygen concentration including the same in nitrogen oxides in an exhaust gas from the engine which controls an air-fuel ratio of an air-fuel mixture by a feedback correction-control based on a oxygen sensor having the nitrogen oxides-reducing catalytic layer, the detection of a theoretical air-fuel ratio is performed on a richer side comparing with the output on the detection of a theoretical air-fuel ratio by an oxygen sensor without the nitrogen oxides-reducing function and is not changed even though the nitrogen oxides concentration changes. Accordingly the feedback air-fuel ratio control operates to decrease the amount of nitrogen oxides and to stabilize the air-fuel ratio control. A first target air-fuel ratio for the air-fuel ratio feedback control is changed to a second target air-fuel ratio which is richer than the first target air-fuel ratio at least when the high nitrogen oxide concentration in the exhaust gas is detected thereby changing of the controlled air-fuel ratio to the too much lean side is avoided.

11 Claims, 7 Drawing Sheets

ELECTRONIC AIR-FUEL RATIO CONTROL APPARATUS IN INTERNAL COMBUSTION ENGINE

Background Of The Invention (1) Industrial Application Field of the Invention The present invention relates to an air-fuel ratio control apparatus in which a fuel injection valve arranged in an intake passage of an internal combustion engine is pulse-controlled in an on-off manner and an optimum air-fuel ratio in an air-fuel mixture sucked in the engine is obtained by electronic feedback control correction. More particularly, the present invention relates to an air-fuel ratio control apparatus in which the amounts discharged of nitrogen oxides ($NO_x$) and unburnt components (CO, HC and the like) are reduced.

(2) Description of the Related Art

As the conventional air-fuel ratio electronic control apparatus in an internal combustion engine, a control apparatus is disclosed in Japanese Patent Application Laid-Open Specification No. 240840/85.

This apparatus is now summarized. A flow quantity Q of air sucked in the engine and the revolution number N of the engine are detected and the basic fuel supply quantity Tp (=K·Q/N: K is a constant) corresponding to the quantity of air sucked in a cylinder is computed. This basic fuel injection quantity is corrected according to the engine temperature and the like and feedback correction is performed based on a signal from an oxygen sensor for detecting the air-fuel ratio of the air-fuel mixture by detecting the oxygen concentration in the exhaust gas, and correction based on a battery voltage or the like is carried out and a fuel injection quantity Ti is finally set.

By putting out a driving pulse signal of a pulse width corresponding to the thus set fuel supply quantity Ti to an electromagnetic fuel injection valve at a predetermined timing, a predetermined quantity of a fuel is injected and supplied to the engine.

The air-fuel ratio feedback correction based on the signal from the oxygen sensor is performed so that the airfuel ratio is controlled to a value close to the target airfuel ratio (theoretical air-fuel ratio). The reason is that the conversion efficiency (purging efficiency) of a ternary catalyst disposed in the exhaust system to oxidize CO and HC (hydrocarbon) in the exhaust gas and reduce $N_O$ for purging the exhaust gas is set so that a highest effect is attained for an exhaust gas discharged when combustion is performed at the theoretical air-fuel ratio.

Accordingly, a system having a known sensor portion structure as disclosed in Japanese Patent Application Laid-Open Specification No. 204365/83 is used for the oxygen sensor.

This system comprises a ceramic tube having an oxygen ion-conducting property and a platinum catalyst layer for promoting the oxidation reaction of CO and HC in the exhaust gas, which is laminated on the outer surface of the ceramic tube. $O_2$ left at a low concentration in the vicinity of the platinum catalyst layer on combustion of an air-fuel mixture richer than the theoretical air-fuel ratio is reacted in a good condition with CO and HC to lower the $O_2$ concentration substantially to zero and increase the difference between this reduced $O_2$ concentration and the $O_2$ concentration in the open air brought into contact with the inner surface of the ceramic tube, whereby a large electromotive force is produced between the inner and outer surfaces of the ceramic tube.

On the other hand, when an air-fuel mixture leaner than the theoretical air-fuel ratio is burnt, since high-concentration $O_2$ and low-concentration CO and HC are present in the exhaust gas, even after by the reaction of $O_2$ with CO and HC, excessive $O_2$ is still present and the difference of the $O_2$ concentration between the inner and outer surfaces of the ceramic tube is small, and no substantial voltage is generated.

The generated electromotive force (output voltage) of the oxygen sensor has such a characteristic that the electromotive force abruptly changes in the vicinity of the theoretical air-fuel ratio, as pointed out above. This output voltage $V_{02}$ is used as the reference voltage (slice level SL) to judge whether the air-fuel ratio of the air-fuel mixture is richer or leaner than the theoretical air-fuel ratio. For example, in the case where the air-fuel ratio is lean (rich), the air-fuel ratio feedback correction coefficient LAMBDA to be multiplied to the above-mentioned basic fuel supply quantity Ti is gradually increased (decreased) by predetermined integration constant, whereby the air-fuel ratio is controlled to a value close to the theoretical air-fuel ratio.

From the comprehensive viewpoint, the above-mentioned ternary catalyst can effectively reduce any of the amounts of CO, HC and $NO_x$ at the control of the air-fuel ratio to the theoretical air-fuel ratio. However, for example, in case of $NO_x$, since the change of the conversion in the vicinity of the theoretical air-fuel ratio is large, in view of the dispersion of parts or the like, it is difficult to obtain a high conversion stably.

Furthermore, although the oxygen component in $NO_x$ should be detected as a part of the oxygen concentration in the exhaust gas, this oxygen cannot be grasped by the oxygen sensor, reversion of the electromotive force tends to occur at the air-fuel ratio leaner by the oxygen component in $NO_x$ than the theoretical air-fuel ratio and the air-fuel ratio is controlled to a lean value, whereby reduction of the conversion of $NO_x$ in the ternary catalyst is promoted.

Therefore, reduction of $NO_x$ is tried by performing EGR (exhaust gas recycle) control in combination. However, mounting of an EGR apparatus results in increase of the cost, and the fuel rating is drastically reduced by reduction of the combustion efficiency by introduction of the exhaust gas.

Under this background, there has been proposed an oxygen sensor in which an $NO_x$-reducing catalyst layer containing rhodium or the like capable of promoting the reduction reaction of $NO_x$ in the exhaust gas is arranged and $NO_x$ is thus reduced, whereby oxygen in $NO_x$ can be detected (see E. P. O. 267,764 A2 and E. P. O. 267,765 A2).

If this oxygen sensor is used, the electromotive force of the oxygen sensor is reversed at the true air-fuel ratio. This true air-fuel ratio is a value shifted to a rich side by the oxygen component in $NO_x$ from the theoretical air-fuel ratio at which the electromotive force is reversed when the oxygen sensor having no capacity of reducing $NO_x$. Accordingly, if this oxygen sensor is used, the air-fuel ratio is shifted to a rich side and controlled to a value close to the true theoretical air-fuel ratio. Furthermore, since the air-fuel ratio is controlled to a substantially constant level irrespectively of the $NO_x$ concentration, the conversions of CO, HC and $NO_x$ are sufficiently increased in the ternary catalyst, and the amounts discharged of CO and HC can be most effectively reduced and the $NO_x$ content can be effectively lowered, with the result that omission of the EGR apparatus becomes possible.

However, even in the case where the air-fuel ratio is thus controlled to the vicinity of the true theoretical air-fuel ratio in the region of a high $NO_x$ concentration, since the $NO_x$ conversion of the ternary catalyst abruptly changes in the vicinity of this value because of the above-mentioned characteristic of the ternary catalyst and the conversion is unstable because of the dispersion of parts and the deterioration and since the air-fuel ratio is temporarily made much leaner by fuel delay (delay of arrival of the fuel at the cylinder) because of the wall flow at the time of acceleration. Accordingly, in the oxygen sensor provided with the $NO_x$-reducing catalyst, when the amount of CO as the base is smallest, the reduction reaction of $2CO + 2NO \rightarrow N_2 + 2CO_2$ is not caused and shifting of the output-reversing region in the vicinity of the theoretical air-fuel ratio becomes impossible. Accordingly, the output-reversing region cannot be brought to the point of improving the conversion of $NO_x$ (true theoretical air-fuel ratio) of the ternary catalyst at the time when the amount of $NO_x$ is largest, and a function of stably reducing $NO_x$ can hardly be obtained.

In the region where the $NO_x$ concentration is low, if the air-fuel ratio is controlled to a value slightly leaner than the theoretical air-fuel ratio, the unburnt components CO and HC are more reduced, and hence, this control is preferred. However, even if the air-fuel ratio is controlled to a rich side, the amount discharged of $NO_x$ is decreased and the amounts discharged of CO and HC are increased, but since the efficiency of conversion of CO and HC can be increased more easily than the efficiency of conversion of $NO_x$ in the ternary catalyst, even in the region of a low $NO_x$ concentration, as in the region of a high $NO_x$ concentration, the control can be facilitated by setting the theoretical air-fuel ratio at a richer level.

SUMMARY OF THE INVENTION

The present invention has been completed so as to solve the foregoing problems. It is therefore a primary object of the present invention to provide an air-fuel control apparatus in which at least in the driving state where the amount formed of $NO_x$ is large, the target air-fuel ratio controlled by an oxygen sensor provided with an $NO_x$-reducing catalyst is shifted to a value richer than the theoretical air-fuel ratio, whereby the foregoing problems are solved.

A secondary object of the present invention is to change the target air-fuel ratio controlled by an oxygen sensor provided with an $NO_x$-reducing catalyst according to the amount formed of $NO_x$.

Another object of the present invention is to set the target air-fuel ratio controlled by a oxygen sensor provided with an $NO_x$-reducing catalyst at a level richer than the theoretical air-fuel ratio in the driving state where the amount formed of $NO_x$ is large and set the target air-fuel ratio at a leaner level in the driving state where the amount formed of $NO_x$ is small.

In the present invention, the change and control of the target air-fuel ratio can be accomplished by changing and setting the reference value or slice level SL, with which the output value of the oxygen sensor provided with the reducing catalyst is compared.

Furthermore, in the present invention, the change and control of the target air-fuel ratio can be accomplished by changing and setting the feedback control constant in the feedback control means for eliminating the deviation of the actually detected air-fuel ratio from the target air-fuel ratio.

In accordance with the present invention, these objects can be attained by an air-fuel ratio control apparatus in an internal combustion engine, which comprises, as shown in FIG. 1, an oxygen sensor provided with a ternary catalyst and arranged in an exhaust passage to detect the oxygen concentration in an exhaust gas, corresponding to the air-fuel ratio in an air-fuel mixture supplied to the engine, said oxygen sensor comprising a catalyst for reducing $NO_x$ (nitrogen oxides) and having such a characteristic that the output value is reversed in the vicinity of the target air-fuel ratio, and air-fuel ratio feedback control means for comparing the output value of the oxygen sensor with a reference value corresponding to the target air-fuel ratio and performing the control of increasing or decreasing the fuel injection quantity to control the air-fuel ratio to a level close to the target air-fuel ratio, wherein target air-fuel ratio-setting means is disposed to set the target air-fuel ratio and change the target air-fuel ratio to a level richer than the theoretical air-fuel ratio at least in the state where the $NO_x$ concentration in the exhaust gas is high.

If this structure is adopted, since the air-fuel ratio is set at a level richer than the theoretical air-fuel ratio at least in the state where the $NO_x$ concentration in the exhaust gas is high, the $NO_x$ conversion in the ternary catalyst can be increased to a level close to the upper limit.

Even if the air-fuel ratio is slightly changed to a rich side, the conversions of CO and HC in the exhaust gas by the ternary catalyst are not so reduced and the amount discharged of $NO_x$ can be greatly reduced while controlling increase of the amounts discharged of CO and HC.

The target air-fuel ratio can be set so that it is changed according to the amount generated of $NO_x$, or when the amount generated of $NO_x$ is large, the target air-fuel ratio can be set at a level richer than the theoretical air-fuel ratio and when the amount generated of $NO_x$ is small, the target air-fuel ratio can be set at a leaner level. The reason is that in the case where the amount generated of $NO_x$ is small, if the air-fuel ratio is shifted to a lean side, the amounts of CO and HC can be reduced.

In order to change the target air-fuel ratio, the reference value, with which the output value of oxygen sensor provided with the reducing catalyst is compared, may be changed, or the feedback control constant in the feedback control means may be changed so as to eliminate the deviation of the actually detected air-fuel ratio from the target air-fuel ratio.

The present invention will now be described in detail with reference to embodiments illustrated in the accompanying drawings. Changes and improvements of these embodiments are included within the technical idea of the present invention, so far as they do not depart from the scope of the claims.

DETAILED DESCRIPTION OF THE PREFERRED EMBODIMENTS

Figure 1:
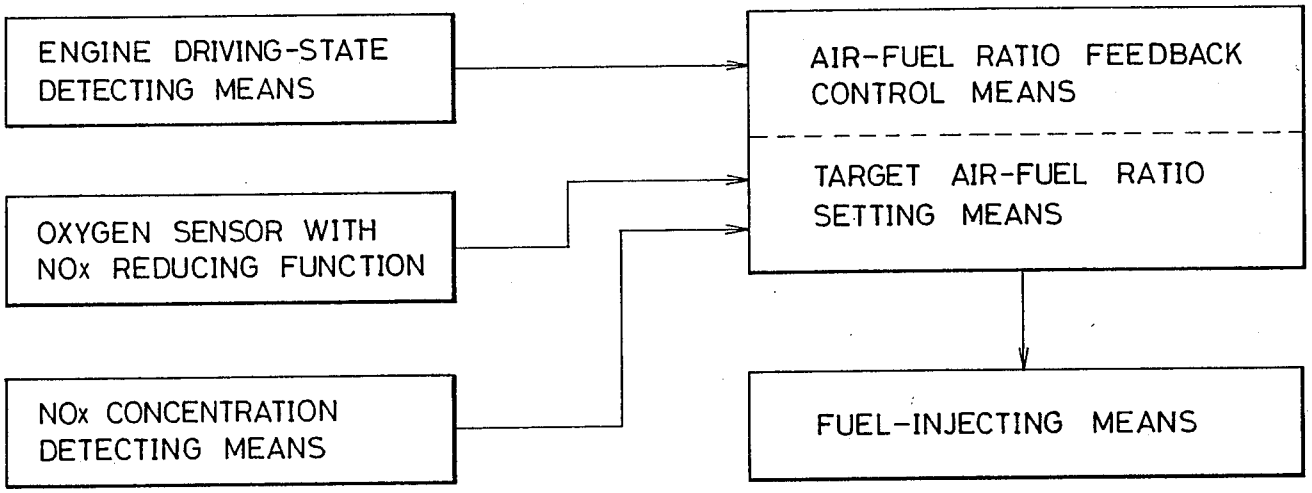
FIG. 1 is a block diagram illustrating the structure of the present invention.
Figure 2:
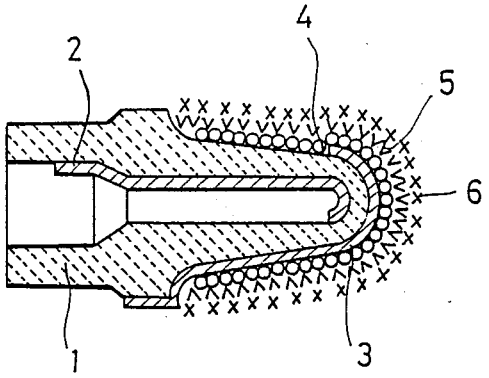
FIG. 2 is a sectional view illustrating the main part of an oxygen sensor used in one embodiment of the present invention.

FIG. 2 illustrates the structure of a sensor portion of an oxygen sensor used in one embodiment of the present invention.

Referring to FIG. 2, inner and outer electrodes 2 and 3 composed of platinum are formed on parts of the inner and outer surfaces of a ceramic tube 1, as the substrate, which is composed mainly of zirconium oxide ($ZrO_2$) which is a solid electrolyte having an oxygen ion-conducting property and has a closed top end portion. Furthermore, a platinum catalyst layer 4 is formed on the surface of the ceramic tube 1 by vacuum deposition of platinum. The platinum catalyst layer 4 is an oxidation catalyst layer for promoting the oxidation reaction of CO and HC in the exhaust gas.

An $NO_x$-reducing catalyst layer 5 (having, for example, a thickness of 0.1 to 5 μm) is formed on the outer surface of the platinum catalyst layer 4 by incorporating particles of a catalyst for promoting the reduction reaction of nitrogen oxides $NO_x$, such as rhodium Rh or ruthenium Ru (in an amount of, for example, 1 to 10%), into a carrier such as titanium oxide $TiO_2$ or lanthanum oxide $La_2O_3$. A metal oxide such as magnesium spinel is flame-sprayed on the outer surface of the $NO_x$-reducing catalyst layer 5 to form a protecting layer 6 for protecting the platinum catalyst layer 4 and the $NO_x$-reducing catalyst layer 5.

Rhodium Rh and ruthenium Ru are publicly known as catalysts for reducing nitrogen oxides $NO_x$, and it has been experimentally confirmed that if titanium oxide $TiO_2$ or lanthanum oxide $La_2O_3$ is used as the carrier for this catalyst, the reduction reaction of $NO_x$ can be performed much more efficiently than in the case where γ-alumina or the like is used as the carrier. Incidentally, in the oxygen sensor shown in FIG. 2, the protecting layer 6 is formed on the outer surface of the reducing catalyst layer 5, but there may be adopted a modification in which the protecting layer 6 is formed between the platinum catalyst layer 4 and the $NO_x$-reducing catalyst layer 5.

In the above-mentioned structure, when nitrogen oxides $NO_x$ contained in the exhaust gas arrive at the $NO_x$-reducing catalyst layer 5, the $NO_x$-reducing catalyst layer 5 promotes the following reactions of $NO_x$ with unburnt components CO and HC contained in the exhaust gas:

$$NO_x + CO \rightarrow N_2 + CO_2$$

$$NO_x + HC \rightarrow N_2 + H_2O + CO_2$$

As the result, the amounts of the unburnt components CO and HC to be reacted with $0_2$ arriving at the platinum catalyst layer 4 located on the inner side of the $NO_x$-reducing layer 5 are reduced by the above reactions in the $NO_x$-reducing catalyst layer 5, and the $O_2$-concentration is accordingly increased.

Therefore, the concentration difference between the $O_2$ concentration on the inner side of the ceramic tube 1 falling in contact with the open air and the $O_2$concentration on the exhaust gas side is reduced, the therefore, the electromotive force of the oxygen sensor is reversed below the reference value (slice level) and reduced on the side richer than in the conventional oxygen sensor in which the $NO_x$ components in the exhaust gas are not reduced, with the result that lean detection can be performed.

Accordingly, if the feedback control of the air-fuel ratio is carried out based on the detection results (the results of the judgement as to whether the air-fuel mixture is rich or lean) of this oxygen sensor, the air-fuel ratio is controlled to a rich level closer to the true theoretical air-fuel ratio, obtained by detecting the oxygen concentration while taking the oxygen component of $NO_x$ into account.

Incidentally, the $NO_x$-reducing catalyst layer 5 has also a function of promoting the reaction of the unburnt components CO and HC with $O_2$. However, since this function is substituted for the function of the platinum catalyst layer 4, the $O_2$ concentration on the exhaust gas side is not reduced.

An embodiment of the apparatus of the present invention for controlling the air-fuel ratio in an internal combustion engine by using the above-mentioned oxygen sensor provided with the $NO_x$-reducing catalyst will now be described.

Figure 3:
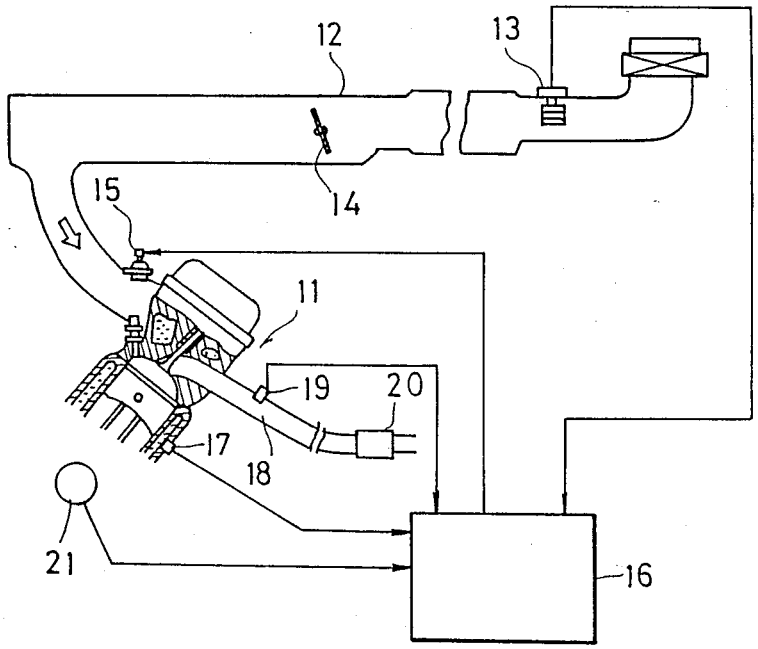
FIG. 3 is a diagram illustrating the system of the embodiment shown in FIG. 2.

Referring to FIG. 3, an air flow meter 13 for detecting the sucked air flow quantity Q and a throttle valve 14 for controlling the sucked air flow quantity Q cooperatively with an accelerator pedal are arranged on an intake passage 12 of an engine 11, and electromagnetic fuel injection valves 15 for respective cylinders are arranged in a manifold portion located downstream. Each fuel injection valve 15 is opened and driven by an injection pulse signal from a control unit 16 having a microcomputer built therein to inject and supply a fuel fed under a pressure from a fuel pump not shown in the drawings and maintained under a predetermined pressure controlled by a pressure regulator. Moreover, a water temperature sensor 17 for detecting the cooling water temperature Tw in a cooling jacket of the engine 11 is arranged, and an oxygen sensor 19 (see FIG. 2 with respect to the structure of the sensor portion) for detecting an air-fuel ratio in a sucked air-fuel mixture by detecting the oxygen concentration in an exhaust gas in an exhaust passage 18 is disposed. Furthermore, there is arranged a ternary catalyst 20 for purging the exhaust gas by performing oxidation of CO and HC and reduction of $NO_x$ in the exhaust gas on the downstream side. A crank angle sensor 21 is built in a distributor not shown in the drawings, and the revolution number of the engine is detected by counting for a predetermined time crank unit angle signals put out from the crank angle sensor 21 synchronously with the revolution of the engine or by measuring the frequency of crank reference angle signals.

Figure 4:
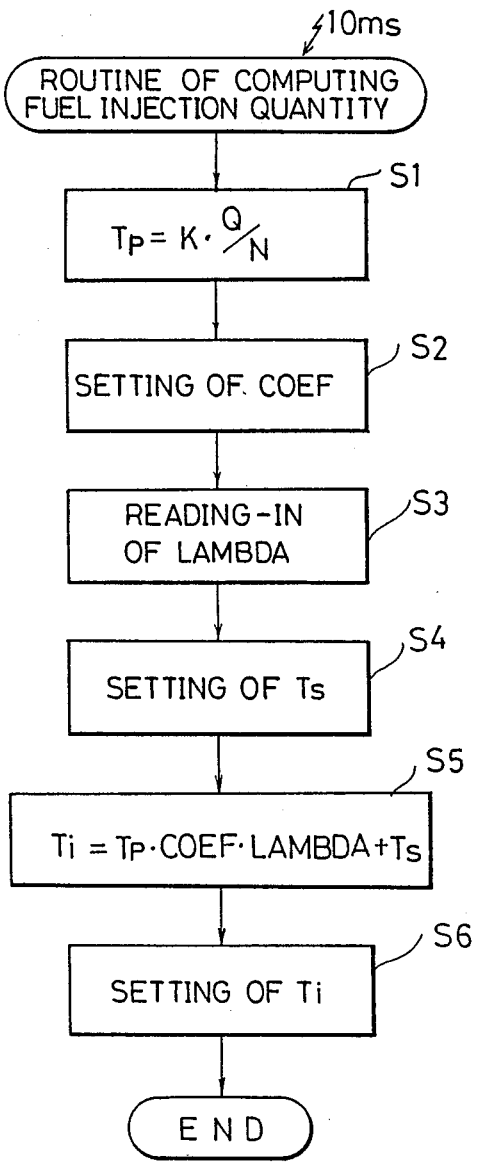
FIG. 4 is a flow chart showing a fuel injection quantity control routine in the embodiment shown in FIG. 2.

The routine of the control of the air-fuel ratio by the control unit 16 will now be described with reference to the flow chart shown in FIG. 4, which illustrates the fuel injection quantity-computing routine. This routine is carried out at a predetermined frequency (for example, 10 ms).

At step (indicated by "S" in the drawings) 1, the basic fuel injection quantity Tp corresponding to the flow quantity Q of sucked air per unit revolution is computed from the sucked air flow quantity Q detected by the air flow meter 13 and the engine revolution number N calculated from the signal from the crank angle sensor 21 according to the following formula:

$$Tp = K \times Q/N \text{ (K is a constant)}$$

At step 2, various correction coefficients COEF are set based on the cooling water temperature Tw detected by the water temperature sensor 17 and other factors.

At step 3, the feedback correction coefficient LAMBDA set based on the signal from the oxygen sensor 19 by the feedback correction coefficient-setting routine, described hereinafter, is read in.

At step 4, the voltage correction portion Ts is set based on the voltage value of the battery. This is to correct the change of the injection quantity in the fuel injection valve 15 by the change of the battery voltage.

At step 5, the final fuel injection quantity Ti is computed according to the following formula:

$$Ti = Tp \times COEF \times LAMBDA + Ts$$

At step 6, the computed fuel injection quantity Ti is set at the output register. The portion including steps 5 and 6 shows a fuel injection quantity computing means. The engine driving state detecting means includes the air flow meter 13, the crank angle sensor 21, the water temperature sensor 17 and others.

According to the above-mentioned routine, a driving pulse signal having a pulse width of the computed fuel injection quantity Ti is given to the fuel injection valve 15 at the predetermined timing synchronous with the revolution of the engine to effect injection of the fuel.

The air-fuel ratio feedback control correction coefficient LAMBDA-setting routine having the feedback control constant-setting function according to the present invention will now be described with reference to FIG. 5. This routine is carried out synchronously with the revolution of the engine and shows an air-fuel ratio feedback control means by incorporated with the routine shown in FIG. 4.

At step 11, the signal voltage $V_{02}$ from the oxygen sensor 19 is read in.

At step 12, the first reference value $SL_O$ (slice level), with which the signal voltage $V_{02}$ is to be compared, is retrieved from the map stored in ROM based on newest data of the present engine revolution number N and the basic fuel injection quantity Tp. This step 12 corresponds to a first target air-fuel ratio setting means according to the present invention. In this map, the driving region is finely divided by N and Tp, and in the region where the combustion temperature is high and the $NO_x$ discharge concentration is increased (experimentally determined and retrieving these regions corresponds to a nitrogen oxides concentration detecting means according to the present invention), the second reference value $SL_H$ of a relatively high voltage corresponding to the air-fuel ratio richer than the true theoretical air-fuel ratio is set (this function corresponds to a second target air-fuel setting means according to the present invention), and in the other region where the $NO_x$ concentration is relatively low, the first reference value $SL_O$ of a relatively low voltage corresponding to the true theoretical air-fuel ratio is set. Instead of this two-staged settings, other setting can be optionally set according to the $NO_x$ concentration.

Incidentally, the map of the reference value SL stored in ROM and the function of changing over and setting the reference value in the map correspond to the first and second target air-fuel ratios-setting means.

Then, the routine goes into step 13, and the signal voltage $V_{02}$ read in at step 11 is compared with the reference value SL ($SL_O$ or $SL_H$) retrieved at step 12.

In the case where the air-fuel ratio is rich ($V_{02} < SL$), the routine goes into step 14, and it is judged whether or not the lean air-fuel ratio has been reversed to the rich air-fuel ratio. When the reversion is judged, the feedback correction coefficient LAMBDA is decreased by a predetermined proportion constant P. When the non-reversion is judged, the routine goes into step 16 and the precedent value of the feedback correction coefficient LAMBDA is decreased by a predetermined integration constant I.

When it is judged at step 13 that the air-fuel ratio is lean ($V_{02} < SL$), the routine goes into step 17 and it is similarly judged whether or not the rich air-fuel ratio has been reversed to the lean air-fuel ratio. The step 13 corresponds to an air-fuel ratio judging means according to the present invention. When the reversion is judged, the routine goes into step 18 and the feedback correction coefficient LAMBDA is increased by a predetermined proportion P. When the non-reversion is judged, the routine goes into step 19 and the precedent value is increased by a predetermined integration constant I.

Thus, the feedback correction coefficient LAMBDA is increased or decreased at a certain gradient. Incidentally, the relation of $I << P$ is established. (In general, the proportion constant P is included in the integration constant I.)

Figure 6:
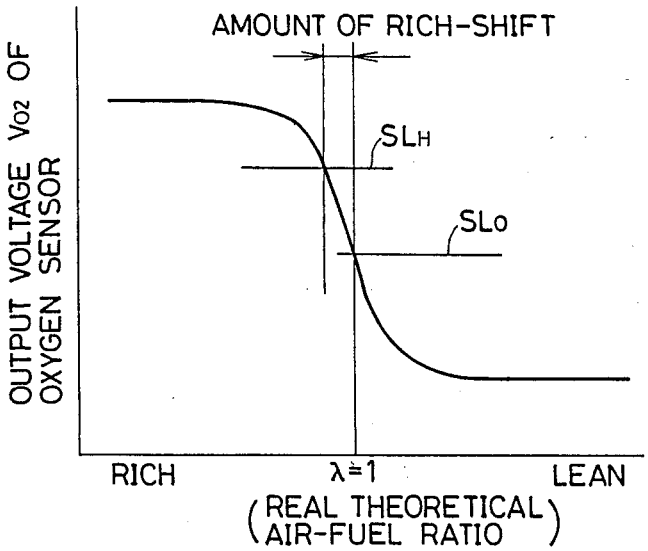
FIG. 6 is a diagram illustrating the characteristics of the oxygen sensor in the embodiment shown in FIG. 2.

According to the above-mentioned routine, in the region where the $NO_x$ concentration in the exhaust gas is high, as shown in FIG. 6, the second reference value $SL_H$ is elevated, whereby the point of the reversion between the rich and lean air-fuel ratios is shifted to the rich side. Since increase-decrease of the feedback correction coefficient LAMBDA is changed over with this reversion point being as the boundary, and therefore, the central value of the control of the air-fuel ratio, that is, the target air-fuel ratio, is shifted to the rich side.

Figure 7:
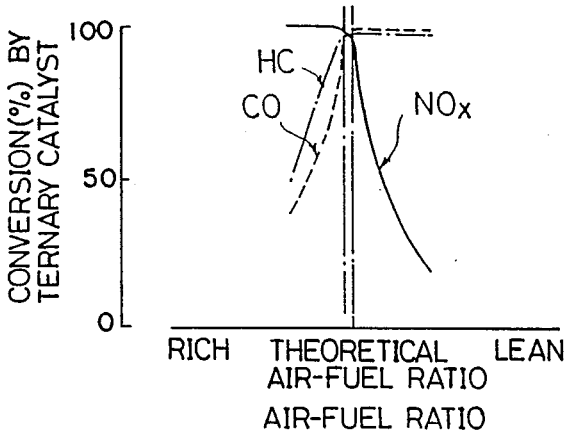
FIG. 7 is a diagram illustrating the characteristics of a ternary catalyst used in the embodiment shown in FIG. 2.

More specifically, in the region where the $NO_x$ concentration is high, the air-fuel ratio is controlled to a level richer than the true theoretical air-fuel ratio, as shown in FIG. 6, the $NO_x$ conversion is stabilized at a sufficiently high level, as is apparent from the characteristics shown in FIG. 7, and even if temporary reduction of the air-fuel ratio to a lean side is caused by the dispersion of parts or deterioration or based on the fuel supply delay at the initial stage of the transitional driving state of the engine, excessive reduction of the airfuel ratio to a lean side is not caused and a good $NO_x$-reducing function can be stably maintained.

Figure 8:
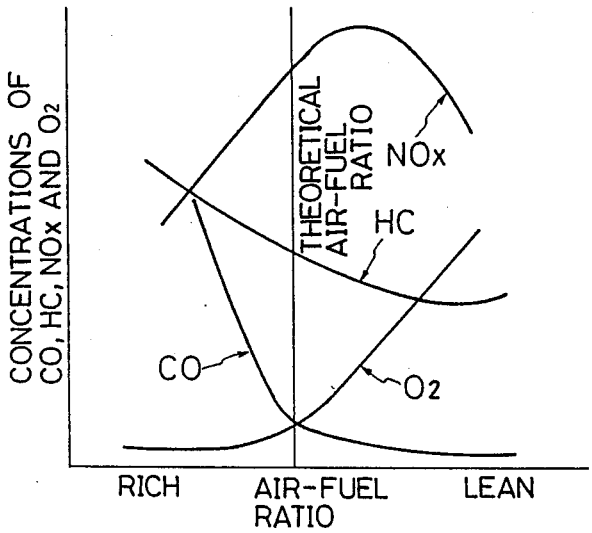
FIG. 8 is a diagram illustrating the concentration characteristics of various exhaust gas components.

Furthermore, since the quantity of shifting of the air-fuel ratio to a rich side is very small (about 3/1000), the $NO_x$ conversion is sufficiently improved. On the other hand, the conversion of CO and HC is not so largely changed according to the hange of the air-fuel ratio as the $NO_x$ concentration, and therefore, reduction of the conversion is only very small. Moreover, in this embodiment, the rich control of the air-fuel ratio is not always performed but is performed only in the region where the $NO_x$ concentration is high, and the CO and HC concentrations are low in the region where the $NO_x$ concentration is high, as shown in FIG. 8. Accordingly, increase of the amounts discharged of CO and HC are sufficiently controlled.

In the transitional driving state of the engine, for example, at the time of acceleration of the engine, the injected fuel flows along the inner wall of the intake passage in the state adhering thereto, and hence, the amount of the fuel is not effectively increased for acceleration, with the result that the air-fuel ratio is temporarily made leaner than the target air-fuel ratio and the $NO_x$ concentration tends to increase. According to the present invention, in this case, since the second target air-fuel ratio is controlled to a level richer than the theoretical air-fuel ratio, even if the above-mentioned reduction of the air-fuel ratio to a lean side is encountered, substantial reduction of the actual air-fuel ratio below the theoretical air-fuel ratio can be prevented.

On the other hand, in the region where the $NO_x$ concentration is low, the reference value to the output voltage of the oxygen sensor 19 is set at a low level, and therefore, the air-fuel ratio corresponding to the reference value $SL_O$ is shifted to a level leaner than the air-fuel ratio in the region where the $NO_x$ concentration is high. Accordingly, the air-fuel ratio is controlled to a value close to the true theoretical air-fuel ratio. In this case, since the conversions of $NO_x$, CO and HC in the ternary catalyst are sufficiently high, the effect of reducing $NO_x$, CO and HC is enhanced. Taking into consideration of the temporal lean phenomena of the air-fuel ratio is not needed since the fuel delay region which possibly occurs in the case of the engine transient state is not included in the low $NO_x$ concentration.

Accordingly, over the entire driving region, the concentrations of CO, HC and $NO_x$ can be reduced with a good balance and the overall exhaust gas emission performance can be greatly improved.

As means for improving the fuel rating, there is known a method in which in the normal driving region, the ignition timing is controlled to an advance side. In this method, the amount of $NO_x$ increases with elevation of the combustion temperature, but if the control is carried out according to the present invention, the $NO_x$ concentration can be reduced and the fuel rating can be improved.

In an engine having a poor combustion stability, in which surging (longitudinal vibration of a vehicle) often occurs, this surging can be controlled by controlling the ignition timing to an advance side, and also in this case, since the increased amount of $NO_x$ can be reduced by performing the control according to the present invention, surging can be effectively controlled.

Figure 9:
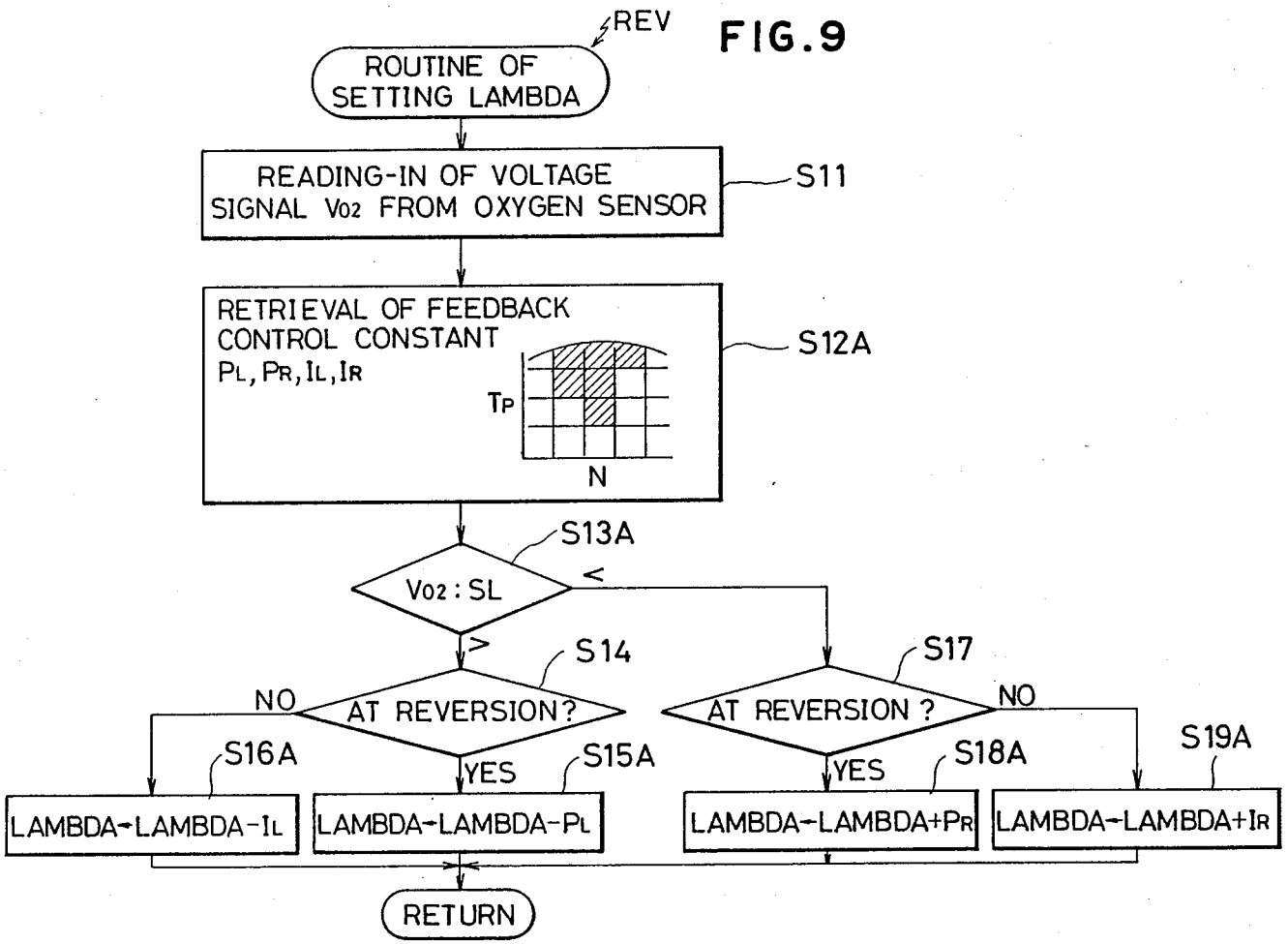
FIG. 9 is a flow chart showing a feedback correction coefficient-setting routine in another embodiment of the present invention.

As another means for shifting the second target air-fuel ratio to a level richer than the theoretical air-fuel ratio at least in the state where the $NO_x$ concentration in the exhaust gas is high, there can be mentioned means for variably setting the feedback control constant This means will now be described with reference to FIG. 9, which is almost the same as the control flow chart shown in FIG. 5, and the differences are mainly described.

At step 12A, the first feedback control constant is retrieved from the map stored in ROM based on newest data of the present engine revolution number N and basic fuel injection quantity Tp. As described below, the feedback control constant comprises the second proportion constant Pr to be added for correction of increase of the fuel supply quantity just after the rich air-fuel ratio has been reversed to the lean air-fuel ratio and the second integration constant Ir to be added for correction of increase of the fuel supply quantity at the time other than the point just after the above-mentioned reversion of the air-fuel ratio. Furthermore, the feedback control constant comprises the first proportion constant Pl to be subtracted for correction of decrease of the fuel supply quantity just after the lean air-fuel ratio has been reversed to the rich air-fuel ratio and the first integration constant Il to be subtracted for correction of decrease of the fuel supply quantity at the time other than the point just after the above-mentioned reversion of the air-fuel ratio. In short, the feedback control constant includes two kinds of constants, each of which has the integration constant and the proportion constant.

In the region where the $NO_x$ concentration in the exhaust gas is high, for example, in the hatched region in the graph shown at step 12 which corresponds to the nitrogen oxygen concentration detecting means, the second proportion constant Pr and integration constant Ir for correction of increase of the fuel supply quantity are set at values larger than the first proportion constant Pl and integration constant Il for correction of decrease of the fuel supply quantity, respectively. In the other region where the $NO_x$ concentration is low, the second proportion constant Pr and integration constant Ir are set at values almost equal to the first proportion constant Pl and integration Il, respectively. The portion of step 12A corresponds to the feedback control constant-setting means which includes the first and second target air-fuel ratio setting means or the first and second feedback control constant-setting means.

Incidentally, the second values of Pr and Ir may be optionally set according to the $NO_x$ concentration.

Then, the routine goes into step 13A, and the signal voltage $V_{02}$ read in at step 11 is compared with the fixed reference value $SL_H$ (theoretical air-fuel ratio).

When the air-fuel ratio is rich ($V_{02} > SL$), the routine goes into step 14A and it is judged whether or not the lean air-fuel ratio has been reversed to the rich air-fuel ratio, which corresponds to the air-fuel ratio judging means. When the reversion is judged, the feedback correction coefficient LAMBDA is decreased by the proportion constant Pl retrieved at step 12. When the non-reversion is judged, the routine goes into step 16A, and the precedent value of the feedback correction coefficient LAMBDA is decreased by the retrieved integration constant Il.

When it is judged at step 13 that the air-fuel ratio is lean ($V_{02} > SL$), the routine goes into step 17A and it is judged whether or not the rich air-fuel ratio has been reversed to the lean air-fuel ratio. When the reversion is judged, the routine goes into step 18A and the feedback correction coefficient LAMBDA is increased by the retrieved proportion Pr. When the non-reversion is judged, the routine goes into step 19A and the precedent value of the feedback correction coefficient LAMBDA is increased by the integration constant Ir.

The feedback correction coefficient LAMBDA is thus increased or decreased at a certain gradient. Incidentally, the relation of Ir, Il, Pr, Pl is established.

Figure 10:
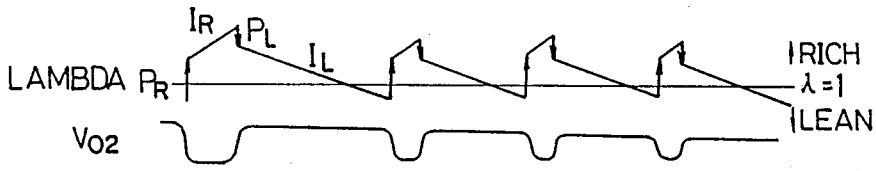
FIG. 10 is a time chart illustrating the changes of the feedback correction coefficient and the output voltage of the oxygen sensor at the time of the control in the embodiment shown in FIG. 9.

If the control is carried out in the above-mentioned manner, since the second proportion constant Pr and integration constant Ir are set at values larger than the first proportion and integration constants Pl and Il, in the region where the $NO_x$ concentration in the exhaust gas is high, the feedback correction coefficient LAMBDA is changed as shown in FIG. 10, and the proportion of the time during which the air-fuel ratio is at a rich level increases in case of Pr $\approx$Pl and Ir $\approx$Il. Namely, the control central value of the air-fuel ratio (target air-fuel ratio) is shifted to the rich side.

Figure 5:
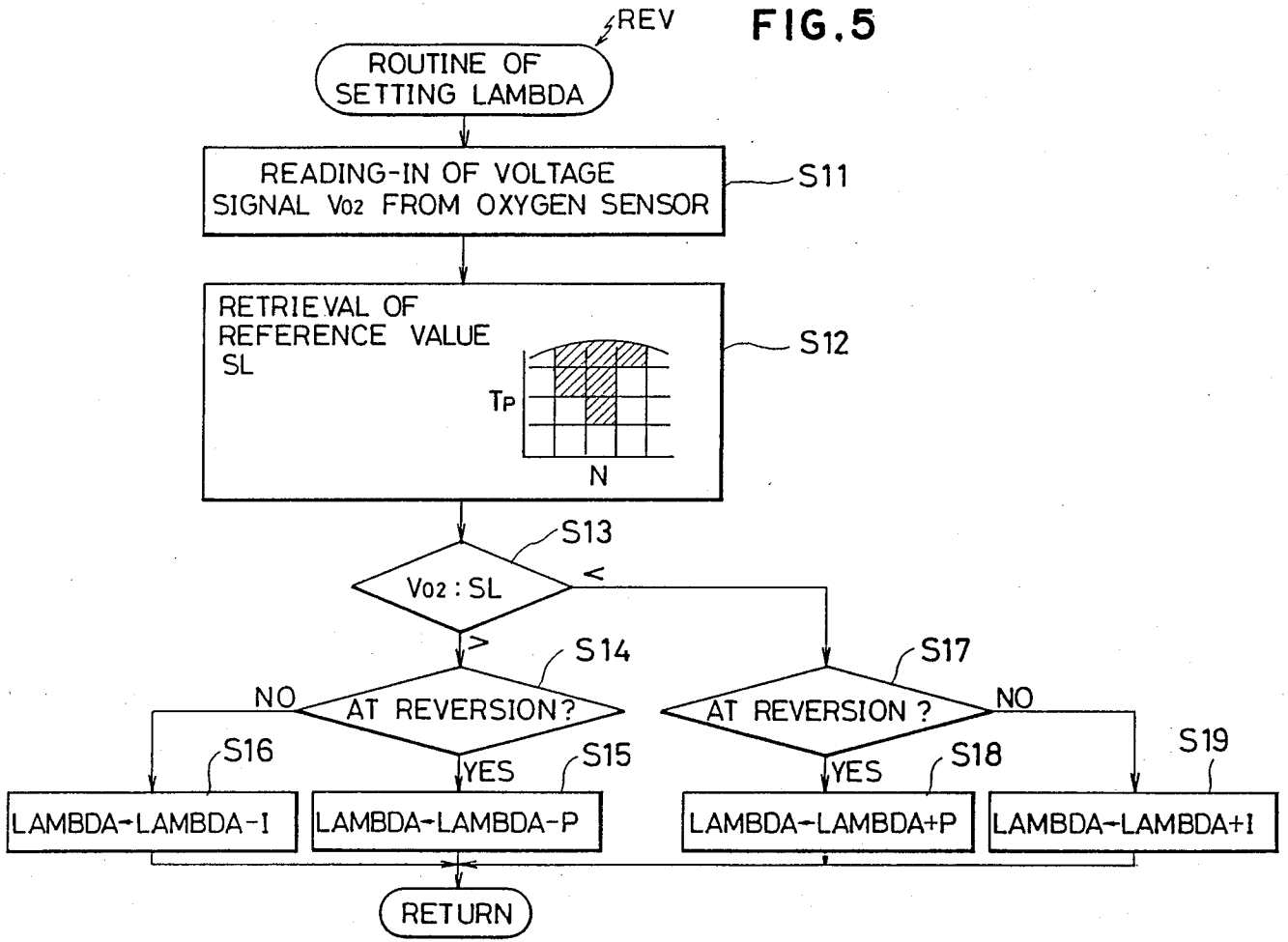
FIG. 5 is a flow chart showing a feedback correction coefficient-setting routine in the embodiment shown in FIG. 2.

Other functions and effects are substantially the same as in the embodiment shown in FIG. 5.

As is apparent from the foregoing description, according to the present invention, the amounts discharged of CO, HC and $NO_x$ can be reduced as much as possible, and the overall exhaust gas emission characteristics can be improved throughout the entire driving region.

Moreover, since the above-mentioned effects can be attained only by the soft ware function and the EGR apparatus or the like becomes unnecessary. Therefore, the cost can be drastically reduced without impairing the performance.

We claim:

1. An electronic air-fuel ratio control apparatus in an internal combustion engine with a ternary catalyst disposed in an exhaust system which is effective in oxidation reaction of carbon oxide and hydro carbon and in reduction reaction of nitrogen oxides when an air-fuel mixture sucked into the engine is in a theoretical air-fuel ratio, which comprises:

an engine driving state-detecting means for detecting a driving state of the engine;

a nitrogen oxides concentration detecting means for detecting nitrogen oxides concentration in the exhaust gas;

an oxygen sensor disposed in the exhaust system of the engine to detect the air-fuel ratio of the air-fuel mixture through the oxygen concentration in the exhaust gas, said oxygen sensor comprising an oxidizing catalyst layer and a nitrogen oxides-reducing catalyst layer for promoting the reaction of reducing nitrogen oxides and emitting a voltage signal with the point of the theoretical air-fuel ratio corresponding to the oxygen concentration in the exhaust gas including the oxygen in the nitrogen oxides;

an air-fuel ratio feedback control means for controlling the air-fuel ratio of the air-fuel mixture by increasing or decreasing a fuel injection quantity to be supplied to the engine based on the engine driving state detected by said engine driving state-detecting means and the air-fuel ratio detected by said oxygen sensor so as to eliminate the deviation of the air-fuel ratio detected by said oxygen sensor from a target air-fuel ratio;

a fuel-injecting means for injecting and supplying a fuel to the engine in an on-off manner according to a driving pulse signal emitted from said air-fuel feedback control means; and said air-fuel ratio feedback control means in which the target air-fuel ratio has first and second target air-fuel ratios and comprising:

a first target air-fuel ratio setting means for setting the first target air-fuel ratio based on the engine driving state detected by said engine driving state detecting means and the air-fuel ratio detected by said oxygen sensor;

a second target air-fuel ratio setting means for changing the first air-fuel ratio to set the second target air-fuel ratio richer than the first air-fuel ratio at least when the high nitrogen oxides concentration is detected by said nitrogen oxides concentration detecting means; and a fuel injection quantity computing means for computing and setting a fuel injection quantity to be injected from said fuel-injecting means to the engine to attain the first target air-fuel ratio or the second target air-fuel ratio of the air-fuel mixture based on the engine driving state, the air-fuel ratio of the air-fuel mixture and the nitrogen oxide concentration.

2. An electronic air-fuel ratio control apparatus as set forth in claim 1 wherein said second target air-fuel ratio setting means sets the second air-fuel ratio to a value thereof which is richer than the theoretical air-fuel ratio when the high nitrogen oxides concentration is detected or to a leaner value thereof when the low nitrogen oxides concentration is detected.

3. An electronic air-fuel ratio control apparatus as set forth in claim 1 wherein said second target air-fuel ratio setting means sets the second air-fuel ratio to the value in response to the nitrogen oxides concentration so that the value richer than the theoretical air-fuel ratio is set as the second target air-fuel ratio when the higher nitrogen oxides concentration is detected.

4. An electronic air-fuel ratio control apparatus as set forth in claim 1 wherein said air-fuel ratio feedback control means further comprises an air-fuel ratio judging means for comparing the voltage signal $V_{02}$ from said oxygen sensor with a slice level $SL_H$ as a reference value to judge the air-fuel ratio of the air-fuel mixture richer or leaner than the slice level $SL_H$ and an air-fuel ratio feedback control correction coefficient setting means for setting an air-fuel ratio feedback control correction coefficient LAMBDA so as to eliminate the deviation of the air-fuel ratio detected by said oxygen sensor from the target air-fuel ratio in a manner of an integration control.

5. An electronic air-fuel ratio control apparatus as set forth in claim 4 wherein said fuel injection quantity computing means computes the fuel injection quantity Ti as following formula;

$$Tp = K \cdot Q/N$$

$$Ti = T \cdot COEF \cdot LAMBDA + Ts$$

where K stands for a constant, Q stands for a quantity of air sucked into the engine and detected by said engine driving state detecting means, N stands for an engine revolution number detected by said engine driving state detecting means, Tp stands for a basic fuel injection quantity, COEF stands for a various correction coefficients of engine driving states and Ts stands for a correction quantity pertaining to a function of a battery voltage for the engine.

6. An electronic air-fuel ratio control apparatus as set forth in claim 4 wherein the slice level SL has first and second slice levels and said first target air-fuel ratio setting means is means for setting first slice level $SL_O$ and said second target air-fuel ratio setting means is means for setting second slice level $SL_H$ higher than the first slice level $SL_O$ so that the second target air-fuel ratio is set in a side richer than the theoretical air-fuel ratio.

7. An electronic air-fuel ratio control apparatus as set forth in claim 6 wherein the second slice level $SL_H$ is changeably set in accordance with the nitrogen oxides concentration.

8. An electronic air-fuel ratio control apparatus as set forth in claim 4 wherein the air-fuel ratio feedback control correction coefficient has first and second coefficients, said first target air-fuel ratio setting means is means for setting the first air-fuel ratio feedback control correction coefficient LAMBDA which is increased or decreased by a first feedback control constant in every air-fuel ratio feedback control routine and said second air-fuel ratio setting means is means for setting the second air-fuel ratio feedback control correction coefficient LAMBDA in every air-fuel ratio feedback control routine, which is increased or decreased by second feedback control constants, one of the second feedback control constants being set to a larger value when the high nitrogen oxides concentration is detected and when the air-fuel ratio feedback control is performed in the direction of increasing the fuel injection quantity rather than the other second feedback control constant set when the air-fuel ratio feedback control is performed in the direction of decreasing the fuel injection quantity.

9. An electronic air-fuel ratio control apparatus as set forth in claim 1 wherein said nitrogen oxides concentration detecting means is means for detecting predetermined engine driving regions at each of where high nitrogen oxides concentration is emitted in the exhaust gas from the engine.

10. An electronic air-fuel ratio control apparatus as set forth in claim 1 wherein said oxygen sensor comprises a substrate composed of a solid electrolyte having an oxygen ion-conducting property, an oxidation catalyst layer for promoting the oxidation reaction of carbon oxide and hydrocarbons in the exhaust gas, which is formed on the exhaust gas-contacting outer surface of the substrate and an $NO_x$ -reducing catalyst layer for promoting the reduction reaction of $NO_x$ in the exhaust gas, which is laminated on the oxidation catalyst layer, and the oxygen sensor has such a structure that the electromotive force generated between the exhaust gas-contacting outer surface of the substrate and the air-contacting inner surface of the substrate is taken out as the output value.

11. An electronic air-fuel ratio control apparatus in an internal combustion engine with a ternary catalyst disposed in an exhaust system which is effective in oxidation reaction of carbon oxide and hydro-carbons and in reduction reaction of nitrogen oxides when an air-fuel mixture sucked into the engine is a theoretical air-fuel ratio, which includes:

an engine driving state-detecting means for detecting a driving state of the engine;

an oxygen sensor disposed in the exhaust system of the engine to detect the air-fuel ratio of the air-fuel mixture through the oxygen concentration in the exhaust gas;

an air-fuel ratio feedback control means for controlling the air-fuel ratio of the air-fuel mixture by increasing or decreasing a fuel injection quantity to be supplied to the engine based on the engine driving state detected by said engine driving state-detecting means and the air-fuel ratio detected by said oxygen sensor so as to eliminate the deviation of the air-fuel ratio detected by said oxygen sensor from a target air-fuel ratio; and a fuel-injecting means for injecting and supplying a fuel to the engine in an on-off manner according to a driving pulse signal emitted from said air-fuel feedback control means;

characterized in that:

said oxygen sensor comprises a nitrogen oxides-reducing catalyst layer for promoting the reaction of reducing nitrogen oxides and emitting a voltage signal with the point of the theoretical air-fuel ratio corresponding to the oxygen concentration in the exhaust gas including the oxygen in the nitrogen oxides, and said air-fuel ratio feedback control means has first and second target air-fuel ratios as said target air-fuel ratio and comprises:

a first target air-fuel ratio setting means for setting the first target air-fuel ratio based on the engine driving state detected by said engine driving state detecting means and the air-fuel ratio detected by said oxygen sensor;

a second target air-fuel ratio setting means for changing the first air-fuel ratio to set the second target air-fuel ratio richer than the first air-fuel ratio at least when the high nitrogen oxides concentration is detected by said nitrogen oxides concentration detecting means; and a fuel injection quantity computing means for computing and setting a fuel injection quantity to be injected from said fuel-injecting means to the engine to attain the first target air-fuel ratio or the second target air-fuel ratio of the air-fuel mixture based on the engine driving state, the air-fuel ratio of the air-fuel mixture and the nitrogen oxide concentration.

* * * * *

UNITED STATES PATENT AND TRADEMARK OFFICE

CERTIFICATE OF CORRECTION

PATENT NO. : 4,915,080
DATED : April 10, 1990
INVENTOR(S) : Shinpei NAKANIWA et al.

It is certified that error appears in the above-indentified patent and that said Letters Patent is hereby corrected as shown below:

At column 1, line 43, change "airfuel" to ---air-fuel---.

At column 1, line 44, change "airfuel" to ---air-fuel---.

At column 1, line 48, change "No" to ---$NO_x$---.
At column 3, line 58, change "a oxygen" to ---an oxygen---.
At column 6, line 17, change "$O_2$concen-" to ---$O_2$ concen---.
At column 9, line 7, change "hange" to ---change---.
At column 9, line 32, change "value" to ---value $\Omega o$---.

At column 10, line 1, change "constant" to ---constant.---.
At column 12, line 41 (claim 4, line 5), change "$SL_H$" to ---SL---.
At column 12, line 43 (claim 4, line 7), change "$SL_H$" to ---SL---.
At column 12, line 57 (claim 5, line 8), change "T" to ---Tp---.

Signed and Sealed this

Twenty-seventh Day of December, 1994

*Attest:*

Bruce Lehman

BRUCE LEHMAN

*Attesting Officer*

*Commissioner of Patents and Trademarks*